US009714131B2

(12) United States Patent
Arora et al.

(10) Patent No.: US 9,714,131 B2
(45) Date of Patent: Jul. 25, 2017

(54) SPRAYHEAD FOR A SPRAY DEVICE

(71) Applicant: Conopco, Inc., Englewood Cliffs, NJ (US)

(72) Inventors: Amit Arora, Leeds (GB); Kassie Terra-Lynn Betts, Carlsbad, CA (US); Simon Lewis Bilton, Leamington Spa (GB); Joseph Butler, Rugby (GB); Christopher John Jones, Tewkesbury (GB); Garen Kouyoumjian, Leamington Spa (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 14/366,143

(22) PCT Filed: Dec. 6, 2012

(86) PCT No.: PCT/EP2012/074609
§ 371 (c)(1),
(2) Date: Jun. 17, 2014

(87) PCT Pub. No.: WO2013/092230
PCT Pub. Date: Jun. 27, 2013

(65) Prior Publication Data

US 2014/0361044 A1 Dec. 11, 2014

(30) Foreign Application Priority Data

Dec. 22, 2011 (EP) ..... 11195091
Apr. 20, 2012 (EP) ..... 12164862

(51) Int. Cl.
*B65D 83/00* (2006.01)
*B65D 83/22* (2006.01)
(Continued)

(52) U.S. Cl.
CPC ..... *B65D 83/22* (2013.01); *B65D 83/205* (2013.01); *B65D 83/206* (2013.01); *B65D 83/752* (2013.01); *B65D 2215/04* (2013.01)

(58) Field of Classification Search
CPC .... B65D 83/20; B65D 83/205; B65D 83/206; B65D 83/22; B65D 83/222; B65D 83/752; B65D 2215/04
See application file for complete search history.

(56) References Cited

U.S. PATENT DOCUMENTS 3,426,948 A 2/1969 Stirling
3,429,483 A 2/1969 Mlcalleff
(Continued)

FOREIGN PATENT DOCUMENTS

AU 48959 1/1980
CN 101528564 9/2009
(Continued)

OTHER PUBLICATIONS

PCT Interanational Search Report in PCT application PCT/EP2012/074609 dated Mar. 18, 2013 with Written Opinion.
(Continued)

*Primary Examiner* — Frederick C Nicolas
*Assistant Examiner* — Bob Zadeh
(74) *Attorney, Agent, or Firm* — Karen E. Klumas

(57) ABSTRACT

A sprayhead for use with an aerosol container, the sprayhead including a chassis capable of firm attachment to the container; a rotatable circular collar; a spray channel and associated actuator button; and an over-cap; the rotatable circular collar being rotatable between a first and second position, wherein, when the rotatable circular collar is in the first position, a holding feature of the rotatable circular collar interacts with a holding feature of the chassis and wherein the rotatable circular collar further includes a projection that
(Continued)

interacts with a non-rotating feature of the overcap to produce an audible signal when the rotatable circular collar is rotated between its first and second position.

9 Claims, 6 Drawing Sheets

(51) Int. Cl.
*B65D 83/20* (2006.01)
*B65D 83/14* (2006.01)

(56) References Cited

U.S. PATENT DOCUMENTS

| | | | | |
|---|---|---|---|---|
| 3,777,789 | A | 12/1973 | Corlet | |
| 4,542,837 | A | 9/1985 | Rayner | |
| 5,337,926 | A * | 8/1994 | Drobish | B05B 1/1645 222/309 |
| 7,017,785 | B2 * | 3/2006 | Lasserre et al. | 222/402.13 |
| 7,487,891 | B2 * | 2/2009 | Yerby et al. | 222/153.13 |
| 7,530,476 | B2 * | 5/2009 | Downey | B65D 83/205 222/153.04 |
| 7,588,171 | B2 | 9/2009 | Reedy et al. | |
| 7,661,568 | B2 | 2/2010 | Vanstaan et al. | |
| 7,686,189 | B2 | 3/2010 | Althoff et al. | |
| 7,699,190 | B2 * | 4/2010 | Hygema | 222/39 |
| 7,861,894 | B2 * | 1/2011 | Walters et al. | 222/153.11 |
| 7,874,465 | B2 | 1/2011 | Bertin | |
| 8,016,159 | B2 * | 9/2011 | Ma | 222/83.5 |
| 8,127,968 | B2 | 3/2012 | Yerby | |
| 8,550,306 | B2 * | 10/2013 | Angus et al. | 222/153.11 |
| 9,260,237 | B2 * | 2/2016 | Brace | B65D 83/226 |
| 2007/0039979 | A1 | 2/2007 | Strand et al. | |
| 2008/0173676 | A1 | 7/2008 | Althoff | |
| 2008/0210710 | A1 | 9/2008 | Marquardt | |
| 2009/0050650 | A1 | 2/2009 | Walters | |
| 2010/0206907 | A1 | 8/2010 | Angus | |
| 2011/0132998 | A1 | 6/2011 | Marzio | |
| 2014/0329918 | A1 * | 11/2014 | Arora | B65D 83/205 514/789 |
| 2014/0361044 | A1 * | 12/2014 | Arora | B65D 83/205 222/153.11 |
| 2014/0361049 | A1 * | 12/2014 | Arora | B65D 83/205 222/402.11 |

FOREIGN PATENT DOCUMENTS

| | | | |
|---|---|---|---|
| CN | 101641267 | | 2/2010 |
| CN | 102248519 | | 4/2014 |
| EP | 0659157 | | 1/1996 |
| EP | 0659157 | B1 | 1/1996 |
| EP | 1040055 | B1 | 7/2002 |
| EP | 2143661 | A2 | 1/2010 |
| EP | 2049415 | B1 | 11/2010 |
| FR | 2705322 | A1 | 11/1994 |
| FR | 2705322 | B1 | 7/1995 |
| JP | 2150055 | | 12/1990 |
| JP | 9040043 | | 2/1997 |
| JP | 2004123136 | | 4/2004 |
| JP | 2004123316 | | 4/2004 |
| JP | 5521020 | U1 | 6/2014 |
| WO | WO2004078635 | A2 | 9/2004 |
| WO | WO2007120570 | A2 | 10/2007 |
| WO | WO 2007120570 | A3 * | 11/2008 |

OTHER PUBLICATIONS

European Search Report in EP application EP 12 16 4862 dated Mar. 8, 2013 with Written Opinion.
PCT International Search Report in PCT application PCT/EP2012/074608 dated Mar. 22, 2013 with Written Opinion.
European Search Report in EP application EP 12 17 2049 dated Mar. 12, 2013 with Written Opinion.
Co-pending Application: Applicant: Arora et al., Filed: Jun. 17, 2014.
PCT International Search Report in PCt application PCT/EP2012/074610 dated Mar. 7, 2013 with Written Opinion.
European Search Report in EP application EP 11 19 5091 dated May 31, 2012 with Written Opinion.
OA dated Jun. 16, 2016 in JP2014-547828 with Human Translation (partial).

* cited by examiner

SPRAYHEAD FOR A SPRAY DEVICE

The present invention is concerned with an actuator cap or sprayhead for a fluid container that allows the contents of the container to be sprayed without the cap having to be removed. The invention is of particular use in the field of home and personal care when it may be used as part of a hand held aerosol dispenser. A particular aspect of the invention is that the sprayhead enables the dispenser with which it is associated to be interchangeably converted between operable and inoperable states.

Sprays through actuator caps enabling conversion between operable and inoperable states, optionally for use with pressurised fluid containers, have been described in the prior art.

WO 2004/078635 (Seaquist) discloses an actuator for an aerosol valve comprising an actuator button rotatable between a locked position and unlocked positions.

EP 1,040,055 B1 (Unilever) discloses a sprayhead comprising an over-cap rotatable between a first position in which actuation is possible and a second position in which actuation is not possible.

U.S. Pat. No. 4,542,837 (Metal Box) discloses an actuator having upper and lower rotatable parts which may be rotated between operable and inoperable positions.

EP 2,049,415 B1 (Valois) discloses a fluid dispensing head comprising actuator means for driving a pushbutton in axial displacement relative to the valve rod, the pushbutton being used to trigger dispensing.

WO 07/120570 (Precision Valve) discloses a locking aerosol dispenser with a dome attached to a base lock member and also attached to an aerosol valve mounting cup of an aerosol can.

It as an object of the present invention to provide a robust, yet ergonomically attractive dispensing means for spraying fluid products, particularly products intended for application to the surface of the human body.

It is a further object of the present invention to provide a sprayhead with a locking means which enables the sprayhead to be converted between operable and inoperable states in such manner than the operator is given multiple sensory indications of the state of the device.

The invention is particularly suitable for applying cosmetic products to the surface of the human body, especially to the underarm regions of the human body.

In a first aspect of the present invention, there is provided a sprayhead suitable for use with an aerosol container, said sprayhead comprising:

- a chassis capable of firm attachment to an aerosol container;
- a rotatable circular collar located largely around and in close proximity to the chassis; and
- a spray channel and associated actuator button, said spray channel being designed to pass through a central aperture in the chassis and being connectable to the central valve stem of an aerosol container with which the sprayhead is designed to be used;

characterised in that the circular collar is rotatable between a first position in which a holding feature of the collar interacts with a holding feature of the chassis and a second position; the sprayhead being inoperable when the circular collar is in its first position and operable when the circular collar is in its second position; the holding features providing rotational resistance to movement; the circular collar further comprising a projection which interacts with a non-rotating feature to produce an audible signal when the circular collar is rotated to and from its first position and to and from its second position.

In a second aspect of the present invention, there is provided a method for applying a cosmetic composition to the surface of the human body comprising the use of a sprayhead according to the first aspect of the invention.

The sprayhead of the present invention is designed for use with a supply of fluid product, particularly fluid cosmetic composition for use on the surface of the human body. The fluid product is supplied from a container to which the sprayhead is attached.

The sprayhead is particularly suitable for use with a pressurised aerosol canister containing the product to be dispensed.

A key feature of the invention is that the sprayhead may be easily interchanged between a first position in which it is inoperable and a second position in which it is operable; that is to say, between a first position in which the spray channel may not be depressed and a second position in which the spray channel may be depressed. This change is brought about not by means of a component that the operator uses to actuate the sprayhead, but by means of a rotatable collar that the operator manually turns to interchange the device between inoperable and operable states.

Other key features of the invention enable the interchange of the sprayhead between its operable and inoperable positions to be performed in a robust manner and a manner which is multi-sensorial. Thus, the sprayhead has holding features providing interaction between the chassis and rotatable collar that provide a robustness of operation and a tactile signal that the sprayhead has been changed from one position to another. Further, the circular collar comprises a projection which interacts with a non-rotating feature of the sprayhead to produce an audible signal when the circular collar is rotated to and from its first position and to and from its second position.

It will be understood that the holding features that provide interaction between the chassis and rotatable collar and the tactile signal that they give is coordinated with the audible signal produced by the projection from the collar interacting with the non-rotating feature of the sprayhead. That is to say, an audible signal is given to the user at the same rotational degree as a tactile signal is given. In preferred embodiments, there are first coordinated audible and tactile signals when the collar is rotated from its first position and second coordinated audible and tactile signals when the collar is rotated into its second position.

In preferred embodiments, the projection from the circular collar which interacts with the over-cap to produce audible signals does so by interacting with a first feature on the over-cap when the circular is rotated from its first position to an intermediate position, between its first and second positions, and with a second feature on the over-cap when the circular is rotated from said intermediate position to its second position.

By having both tactile and audible signals concerning the state of rotation of the rotatable collar, the user may be more reliably informed as to the status of the device: operable or inoperable. By having these signals given by independent components of the sprayhead, the required degree of robustness of operation may be achieved without compromising the sound quality of the audible signal. Similarly, the required quality of the audible signal may be achieved without compromising the robustness of operation.

The spray channel, which is connectable to a central valve stem of an aerosol container with which the sprayhead is designed to be used, preferably passes through both a central aperture in the circular platform of the chassis and a central aperture in a bridge spanning a diameter of the collar. This double central holding of spray channel avoids any "in use" lateral pressure upon the valve of the aerosol container with which the sprayhead is designed to be used. Further, this mechanical interaction between the three components of the sprayhead and the valve stem of the associated aerosol container gives great "in use" robustness and strength.

Herein, orientation terms such "top" and "bottom", "upper" and "lower", "above" and "below", should be understood to refer to the sprayhead in the position it would occupy in normal use sat on the top of a vertically orientated aerosol can with which it is designed to be used, as illustrated in FIG. 1, for example.

When the outlet of the spray channel has a radially disposed outlet, the "front" of the sprayhead should be understood to be in the same radial direction as said outlet. By analogy, the "rear" of the sprayhead should be understood to be the opposite radial direction. "Sides" of the sprayhead should be understood to be "faces" radially orthogonal to the front-to-rear axis.

Herein, the term "central" is used with reference to a plane orthogonal to the top-to-bottom "long" axis of a vertically orientated aerosol can with which the sprayhead is designed to be used. It should also be understood to refer to this plane of the sprayhead as whole, rather than any particular component thereof.

Herein, the term "principle axis" should be understood to be the top-to-bottom "long" axis of a vertically orientated aerosol can with which the sprayhead is designed to be used and the top-to-bottom axis of the sprayhead itself.

Herein, the terms "clockwise" and "anti-clockwise" should be understood to be with reference to the sprayhead as viewed from above.

When present, the bridge spanning a diameter of the collar does not need to be a single element and nor does it need to link directly to the extreme radial edges of the collar. In preferred embodiments, the bridge spans the collar at the upper end thereof. It is further preferred that the bridge abuts a section protruding from the top of the circular platform of the chassis, said protruding section limiting the rotational movement of the collar because of its interaction with bridge thereof. Nevertheless, it is essential that the collar retains ability to rotate between a first position in which the sprayhead is inoperable and the bridge preferably abuts a first edge of a section protruding from the top of the circular platform of the chassis and a second position in which the sprayhead is operable and the bridge preferably abuts a second edge of a section protruding from the top of the circular platform of the chassis.

In preferred embodiments, the sprayhead comprises a fourth essential component: an upper body or over-cap designed to fit over the chassis and spray channel. The upper body or over-cap may define a first aperture, optionally covered by a flexible membrane, located over the actuator button associated with the spray channel and a second aperture surrounding an outlet from the spray channel such as to allow passage of a product from the spray channel to the exterior. The over-cap may serve to protect the spray channel, which is often the most fragile element of the sprayhead. The over-cap is held in radial stasis relative to the chassis for optimum benefit.

In preferred embodiments, the spray channel comprises an upright central segment, connectable at its lower end to a valve stem of an associated aerosol can and connecting at its upper end to a segment projecting radially outward from the central segment. In such embodiments, the central segment is in fluid connection with the segment projecting radially outward therefrom and also with the valve stem, when connected thereto. The segment of the spray channel projecting radially outwards does not need to be in the plane orthogonal to the principle axis of the sprayhead, but it does need to have a component of its projection in said plane.

The holding feature of the collar is typically a projection and more typically a radial projection therefrom. It interacts with a holding feature of the chassis and provides rotational resistance to movement. Typically, a holding feature of the circular collar also interacts with a second holding feature on the chassis when collar is in its second position. In preferred embodiments of this type, a first holding feature of the circular collar interacts with a first holding feature on the chassis when the collar is in its first position and a second holding feature of the circular collar interacts with a second holding feature on the chassis when the collar is in its second position. The second holding feature of the circular collar is also typically a projection and more typically a radial projection therefrom.

In preferred embodiments, the holding feature or features on the chassis are radial indents in the chassis.

It may be noted that the interaction between the holding features on the chassis and the holding features on the rotatable collar give a tactile signal to the user that the collar has moved from one position to another. They may also give an audible signal; however, this is not essential (vide infra).

In addition to its holding features, the circular collar also comprises a projection which interacts with a non-rotating feature to produce an audible signal when the circular collar is rotated to and from its first position and to and from its second position.

In preferred embodiments, the circular collar comprises a projection which interacts with a first non-rotating feature to produce an audible signal when the circular collar is rotated to and from its first position and with a second non-rotating feature to produce an audible signal when the circular collar is rotated to and from its second position. In such embodiments, the rotatable collar has three positions, corresponding to the aforementioned first position of the sprayhead in which the sprayhead is inoperable, the aforementioned second position of the sprayhead in which the sprayhead is operable and a position intermediate of these two positions.

In embodiments as described in the paragraph immediately above, it is possible to have different audible signals on rotating the collar from its first position to its intermediate position compared with its rotation from its intermediate position into its second position. This may be achieved in a variety of ways and gives the benefit of further differentiating and signalling between the operable and inoperable states of the sprayhead.

It may be noted that the interaction between the projection from the rotatable collar and the non-rotatable feature that give the audible signals to the user may also give a tactile signal; however, this is not essential (vide supra).

Preferably, the non-rotating feature or features involved in producing the audible signals is or are part of a spray through over-cap sitting over chassis, typically on the inner surface thereof.

The components of the sprayhead are typically made from plastic. The chassis may be made from polypropylene, as may the spray channel and the upper body, when present. When the upper body has a flexible membrane covering a first aperture located over the actuator button associated with the spray channel, this is typically made from a thermoplastic elastomer.

The features described with reference to the following specific embodiment may be considered preferred features of the generic description given above and/or may be incorporated independently into the subject matter as described the following claims.

FIG. 4 is an enlargement of a section of FIG. 4.

Figure 1:
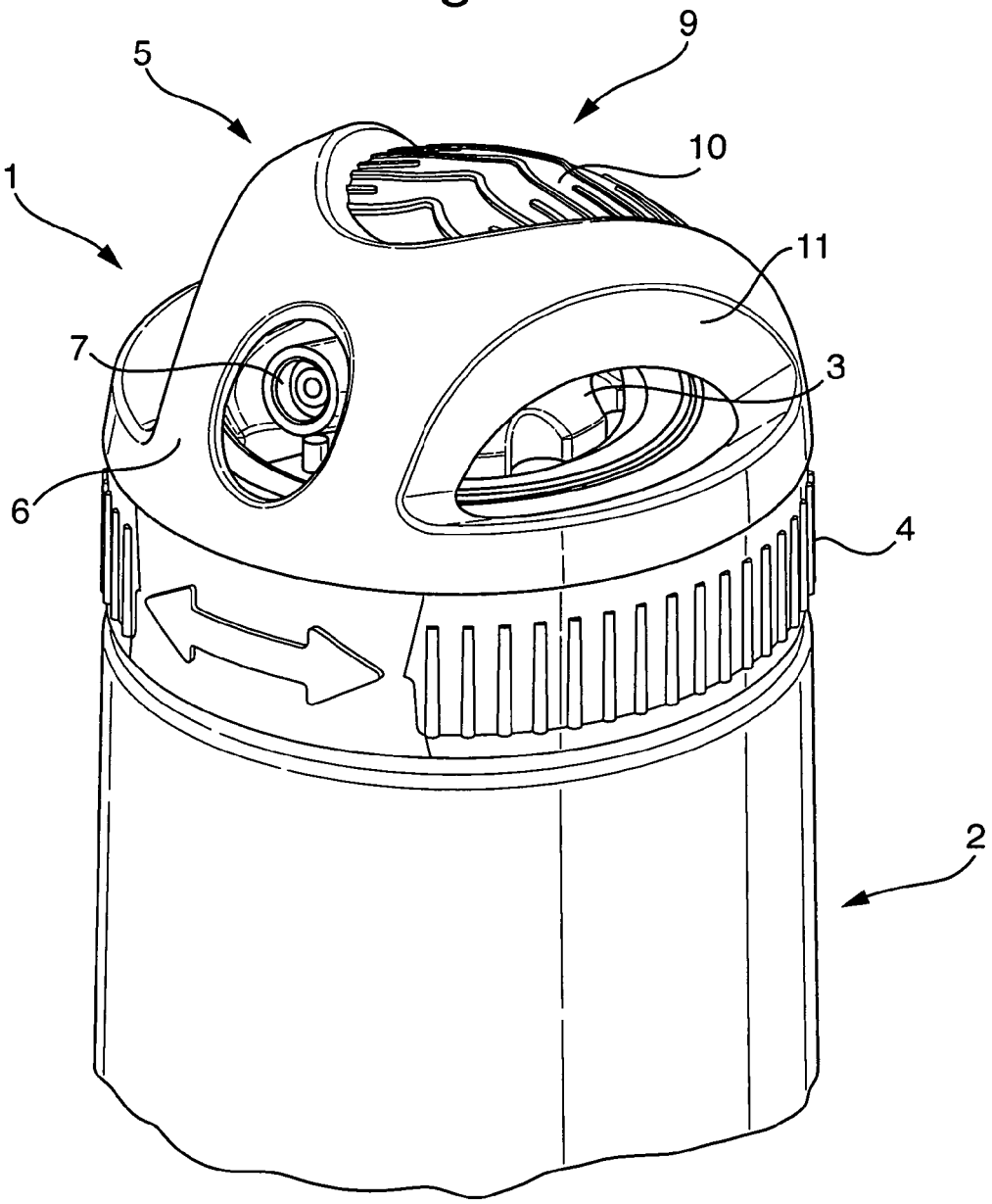
FIG. 1 is an angled view of the sprayhead (1) from top, together with a part view of an associated aerosol can (2).

FIG. 1 illustrates the sprayhead (1) sat on the top of a vertically orientated aerosol can (2) (shown in part) with which it is designed to be used. Features of the sprayhead (1) which can be seen in part are a chassis (3), a rotatable circular collar (4), and an upper body (5) defining a front aperture (6) through which an outlet (7) at the end of spray channel (8) may be seen. The upper body (5) also defines an upper aperture (9) covered by a flexible membrane (10) and two side apertures (11), one of which may be seen in FIG. 1, which reveal the chassis (3) underneath.

Figure 2:
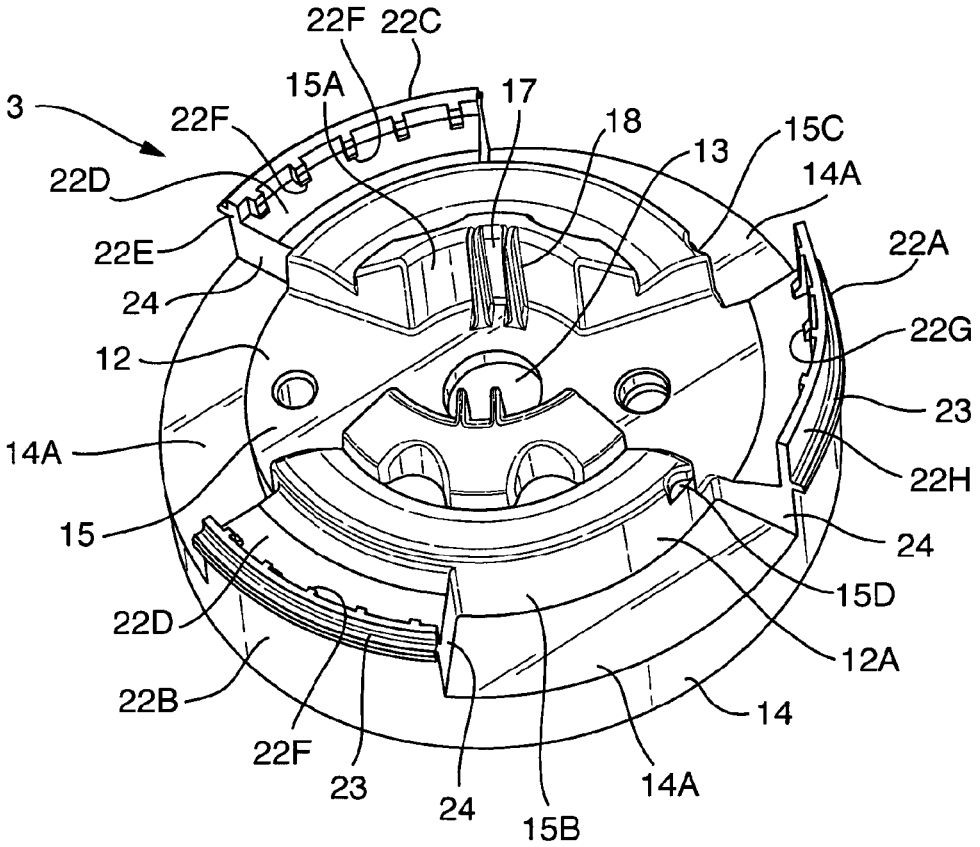
FIGS. 2 and 3 are angled views of a chassis (3) of the sprayhead (1) from above and below, respectively.
Figure 3:
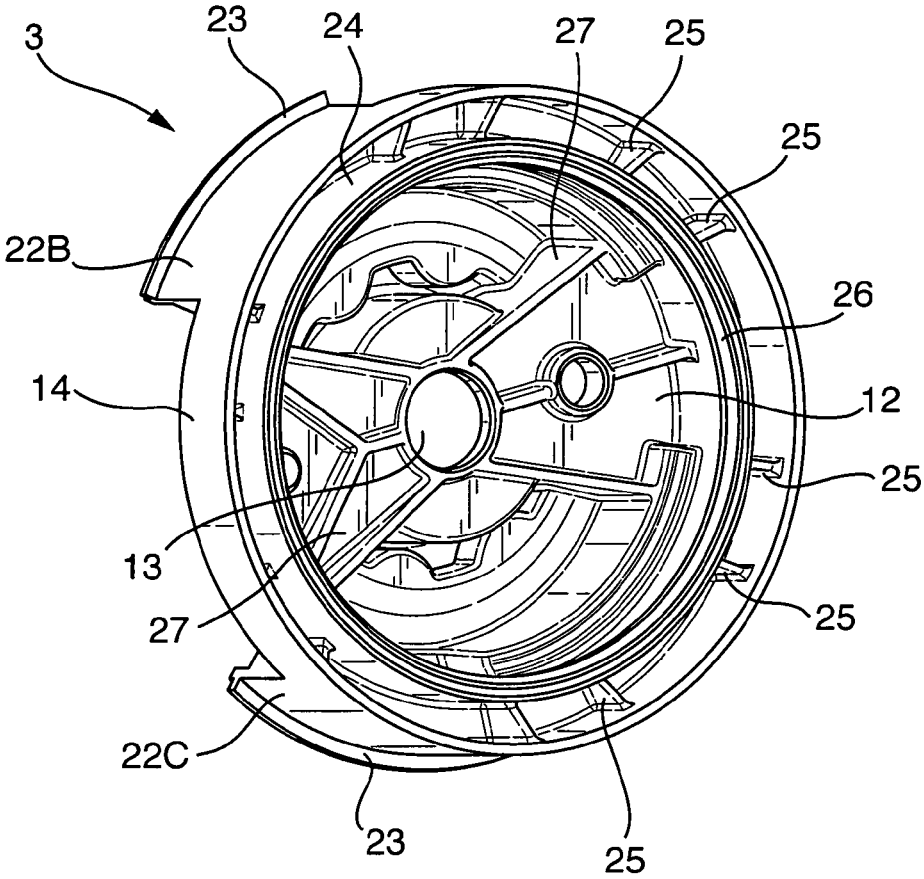

FIGS. 2 and 3 illustrate the chassis (3) in further detail. It may be seen that the chassis (3) has a circular platform (12) extending across its central region punctuated by a central aperture (13) and that there is a circular wall (12A) depending from its edge. The chassis (3) also has a peripheral skirt (14) around its circumference. The upper edge of the peripheral skirt (14) is separated from the lower edge of the circular wall (12A) depending from the circular platform (12) by an annular platform (14A).

Protruding upwards from the circular platform (12) are two sections (15) which are diagonally opposed on either side of the central aperture (13). Between these two protruding sections (15), a bridge (16) of the rotatable collar (4) sits on the upper surface of the circular platform (12) when the sprayhead is fully assembled (vide infra). The inner surface (15A) of each of these protruding sections (15) has the shape of the internal surface of a tube having its central axis as the principle axis of the sprayhead (1) and each having the same radius of curvature. Each inner surface (15A) bears a guide slot (17) between each of two internal projections (18) from said inner surface (15A). The guide slots (17) are diagonally opposed on either side of the central aperture (13) and are designed to accommodate wing elements (19) projecting from a central upright segment (20) of a spray channel (8) (vide infra). The interaction between the guide slots (17) in the chassis (3) and wing elements (19) of the spray channel (8) serves to restrict rotational movement of the spray channel (8) relative to the chassis (3).

The outer surface (15B) of each of the protruding sections (15) is an extension of the circular wall (12A) at the edge of the circular platform (12).

FIG. 2 also illustrates three arcuate peripheral projections (22A, 22B, and 22C) equally spaced circumferentially around the upper edge of the peripheral skirt (15). One of these projections (22A) is located towards the rear of the chassis (3) and does not radially overlap with the protruding sections (15). The other two projections (22B and 22C) are radially disposed at 120° from the first (22A) and do radially overlap with the protruding sections (15).

Each of these projections (22A, 22B, and 22C) has a bead (23) on its outer surface close to its upper end designed to interact with the rotatable collar (4) and restrict axial movement between the chassis (3), the rotatable collar (4) and the upper body (42) (vide infra).

The peripheral projections (22A, 22B, and 22C) are connected to the circular platform (12) by link walls (24) running from their radial ends to the circular wall (12A) depending from the circular platform (12). For the two peripheral projections (22B and 22C) that radially overlap the protruding sections (15), the link walls (24) also link to the outer surface (15B) of the protruding section (15). These two peripheral projections (22B and 22C) each have an arcuate platform (22D) running part way from their inner surface towards the outer surface (15B) of the protruding section (15). These arcuate platforms (22D) form the top surface of each peripheral projection (22B or 22C) of which they are a part, other than a short wall (22E) extending upwards at the outer edge of the peripheral projections (22B and 22C). The short walls (22E) each bear one of the aforementioned beads (23) on their outer surface and each have struts (22F) on their inner surfaces. Similar, but longer struts (22G) exist on the inner surface on a wall (22H) extending upwards at the outer edge of the peripheral projection (22A) that does not radially overlap the protruding sections (15).

Each of the protruding sections (15) has an indent (15C and 15D) in its outer surface (15B) near its top and radially adjacent to its rearmost edge. The indents are approximately semi-circular and form radial recesses into the outer surfaces (15B) of the protruding sections (15).

FIG. 3 shows that the chassis (3) has an internal skirt (24) located somewhat inside peripheral skirt (15) and linked thereto by numerous support bridges (25) (some labelled).

The internal skirt (24) has an annular valve cup securing bead (26) around its inner surface close to its lower end designed to hold the chassis firmly and non-rotatably to the valve cup of an aerosol can with which the sprayhead (1) is designed to be used.

FIG. 3 also illustrates that the lower surface of the circular platform (12) of the chassis (3) possesses several strengthening struts (27) (some labelled) that serve to augment the robustness of the sprayhead (1).

Figure 4:
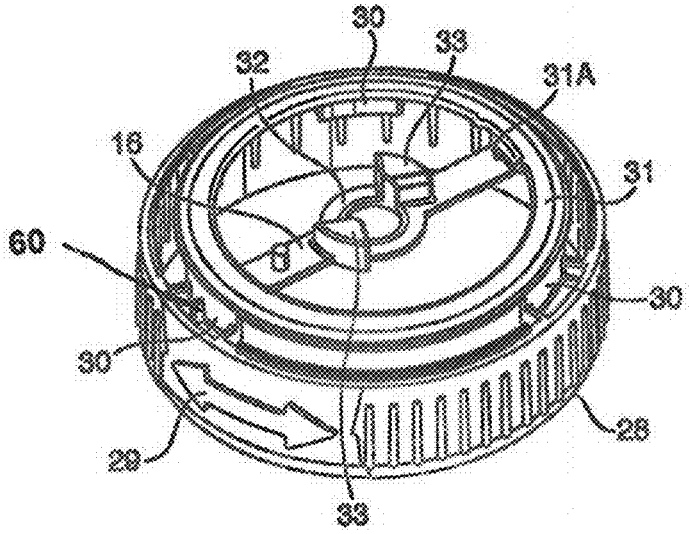
FIGS. 4 and 5 are angled views of a rotatable circular collar (4) of the sprayhead (1) from above and below, respectively.
Figure 5:
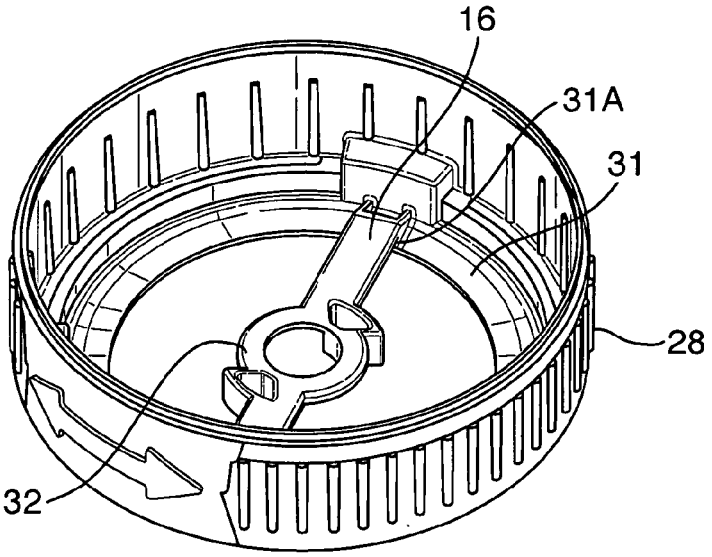

FIGS. 4 and 5 illustrate features of the rotatable circular collar (4) in further detail. The collar (4) has a knurled outer wall (28) bearing a left-right doubled headed arrow graphic (29) to indicate to the user that the collar (4) is rotatable. Linked to the outer wall (28) at it top end by three bridge elements (30), radially equally spaced around collar (4), is a circular disc (31). The circular disc (31) is held somewhat above the top the outer wall (28) by the bridge elements (30) and is designed to sit on the arcuate platforms (22D) of the peripheral projections (22B and 22C) that radially overlap with the protruding sections (15) of the chassis (3). The inner edge of the circular disc (31) abuts the outer surface (15B) of each of the protruding sections (15) and the outer edge is within the walls (22E and 22H) extending upwards at the outer edge of the peripheral projections (22A, 22B, and 22C).

Suspended from the circular disc (31) by diagonally opposed linkages (31 A) there is a bridge (16), spanning a diameter of the circular disc (31). The linkages (31 A) hold the main body of the bridge (16) at a height approximately level with the top of the outer wall (28).

The bridge (16) comprises an annular ring (32) at its centre, through which a central upright segment (20) of a spray channel (8) is designed to fit (vide infra). The bridge (16) is designed to sit on the circular platform (12) of the chassis (3) and to be rotatable thereon between the confines imposed by the sections (15) protruding from the circular platform (12). Protruding from the upper surface of the bridge (16) and bordering the annular ring (32) thereof are two truncated wedge elements (33).

Figure 4A:
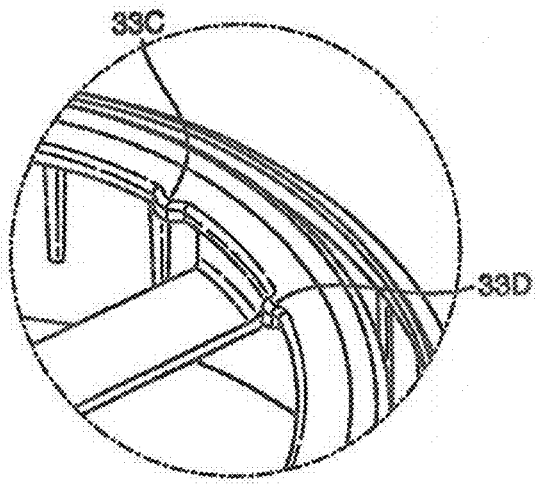

FIG. 4A is an enlarged section of FIG. 4 showing two projections (33C and 33D) from the circular disc (31) of the rotatable collar (4). These two projections (33C and 33D) are of roughly semi-circular shape and protrude radially inward. They are radially located on either side of where the bridge (16) links onto the circular disc (31) via one of the linkages (31A). They serve as holding features for the rotatable collar (4) by interaction with the radial indents (15C and 15D) in the protruding sections (15) of the chassis (3).

At the maximum anti-clockwise rotation of the collar (4), the radial projection (33C) situated anti-clockwise of the adjacent bridge linkage (31A) clicks into the adjacent radial indent (15C) in the outer surface (15B) of the protruding section (15) of the chassis (4). In this position, the sprayhead (1) is in its operable state and may be actuated by pressure on the actuator button (39) (vide infra).

At the maximum clockwise rotation of the collar (4), the radial projection (33D) situated clockwise of the adjacent bridge linkage (31A) clicks into the adjacent radial indent (15D) in the outer surface (15B) of the protruding section (15) of the chassis (4). In this position, the sprayhead (1) is in its inoperable state and may not be actuated.

The two sets of radial projections (33C and 33D) and radial indents (15C and 15D) function as holding features and provide a resistance to rotational movement. The resistance may be overcome by gentle hard pressure, but the holding features provide a tactile signal to the user that the collar (4) orientation has changed. Radial projection (33D) is a first holding feature of the rotatable collar (4) and radial indent (15D) is a first holding feature of the chassis (3); radial projection (33C) is a second holding feature of the rotatable collar (4) and radial indent (15C) is a second holdling feature of the chassis (3).

Figure 6:
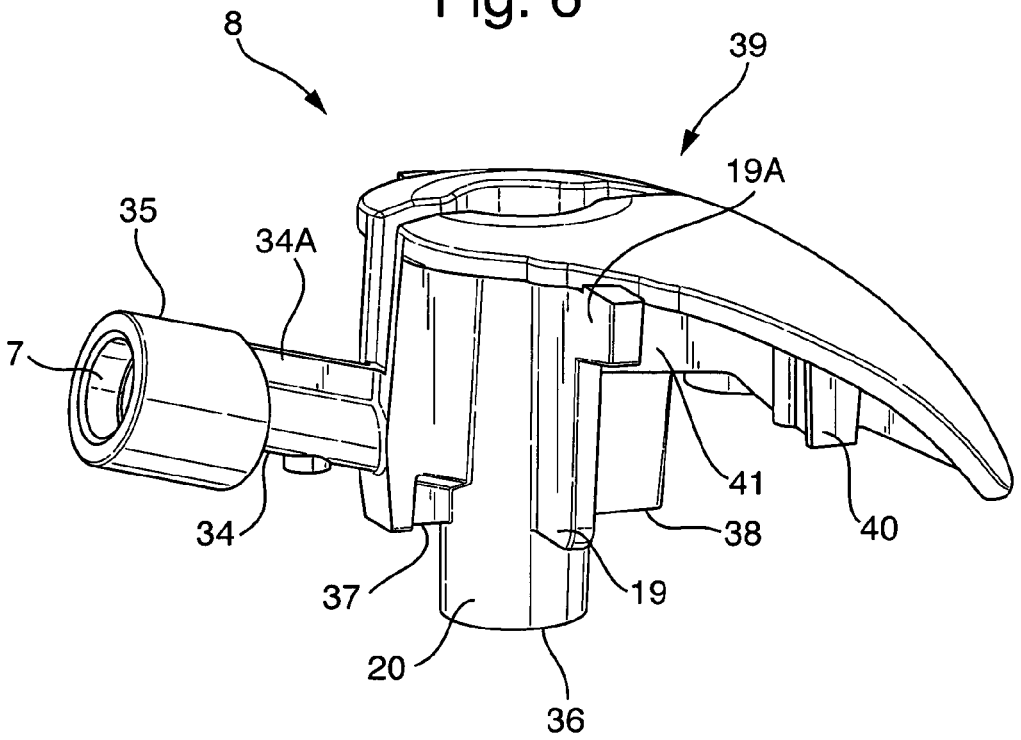
FIG. 6 is a view of a spray channel (8) and associated elements of the sprayhead (1).

The spray channel (8) illustrated in FIG. 6 comprises a central upright segment (20) and a radial segment (34) that slopes upwards as it radiates outwards. The radial segment (34) is terminated by an expanded section (35), which may accommodate a swirl chamber (not shown) and which has the outlet (7) of the spray channel (8) at its terminus. The radial segment (34) has a strengthening strut (34A) protruding upwards from its outer surface.

The radial segment (34) is in fluid communication with the central upright segment (20) which is itself in fluid communication with a valve stem of an associated aerosol can (2) (not shown) via a valve stem socket (36) when the sprayhead (1) is in use.

The central upright segment (20) has wing elements (19) projecting radially outwards from its sidewall in opposite directions orthogonal to the radial direction of the radial segment (34) of the spray channel (8). These wing elements (19) are designed to fit within the guide slots (17) on either side of the central aperture (13) of the chassis (3). (vide supra). The wing elements (19) do extend outwards from the lower region of the central upright segment (20).

The central upright segment (20) also has fore and aft projections (37 and 38, respectively) from its sidewall. The fore projection (37) has the same radial direction as the radial segment (34) of the spray channel (8) and the aft projection (38) projects outwards in the opposite radial direction. The fore projection (37) has a T-shaped cross-section at its lower end. The fore and aft projections (37 and 38, respectively) do extend outwards from the lower region of the central upright segment (20), both terminating at same axial height at which the wing elements (19) orthogonal to them terminate.

At there upper ends, the wing elements (19) project out distinctly further, to give what might be called upper wing extensions (19A).

Associated with the spray channel (8) at its top end is an actuator button (39) which curves downwards towards the rear and has a vaulted shape when viewed from above. On the underside of the actuator button (39) there are several strengthening struts, only two of which (40 and 41) are illustrated.

Figure 7:
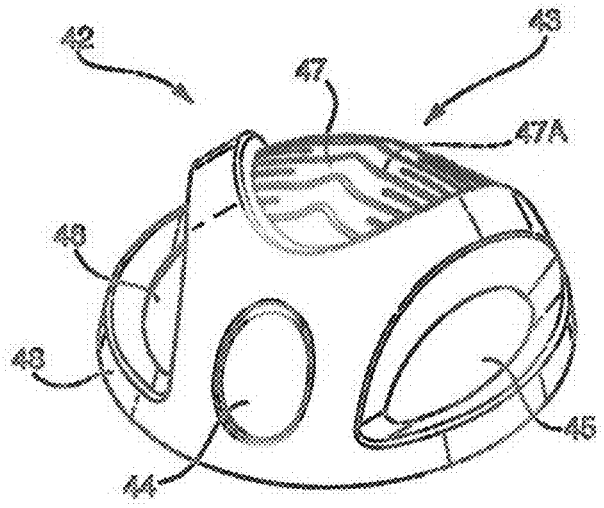
FIGS. 7 and 8 are views of an upper body (42) of the sprayhead (1) from above and below respectively.
Figure 8:
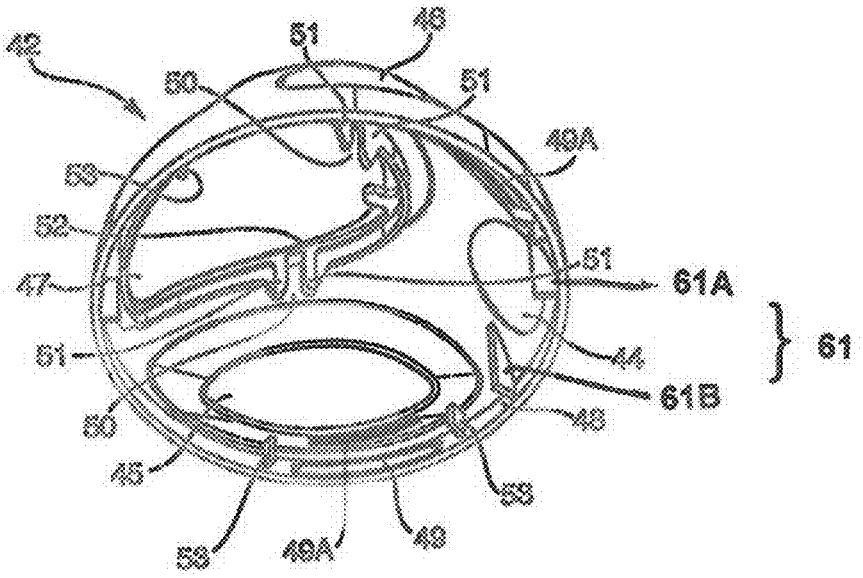

Sat over all the other components of the sprayhead (1), there is an upper body (42) as illustrated in FIGS. 7 and 8. The upper body (42) defines a first aperture (43) located over the actuator button (39) associated with the spray channel (8) and a second aperture 44) surrounding the outlet (7) from the spray channel (8).

The upper body (42) also defines two side apertures (45 and 46) which afford the consumer a view of internal features of the sprayhead (1).

The first aperture (43) is covered by a flexible membrane (47) which has ridges (47A) on its upper surface and is typically made of a thermoplastic elastomer.

The upper body (42) has a peripheral skirt (48) of circular cross-section. This skirt (48) overlaps the three arcuate peripheral projections (22A, 22B, and 22C) which upwardly extend the peripheral skirt (15) of the chassis (3). The peripheral skirt (48) of the upper body (42) has three inward projecting ridges (49) equally spaced around its lower inner edge. One of these ridges (49) is illustrated in FIG. 8. These three ridges (49) are designed to clip under the beads (23) on the outer surface of each of the peripheral projections (22A, 22B, and 22C) from the chassis (3) and thereby hold the upper body (42) and chassis (3) axially together.

The lower edges of the inward projecting ridges (49) sit on the upper edge of the knurled outer wall (28) of the collar (4), but do not restrict rotation thereof.

FIG. 8 illustrates two of three ridges (49A) that project downward from the bottom of the inner surface of the upper body or over-cap (42). These downward projecting ridges (49A) are radially aligned with the inward projecting ridges (49) from the peripheral skirt (48) of the upper body (42) and are designed to interact with the struts (22F and 22G) on the inner surfaces of the walls (22E and 22H) at the edges of and the arcuate platform (22) of the chassis (3) and thereby enhance the robustness of the connection between the upper body (42 and the chassis (3).

Upper body or over-cap (42 includes feature(s) (61), shown as first feature (61A) and second feature (61B), which appear as projections. Projection (60) on rotatable collar (4) interacts with first feature (61A) and second feature (61B) to produce audible signals when the collar is rotated.

Other features of the upper body (42) that can be seen in FIG. 8 are two downward projecting slots (50) between projections (51) from the edge of the first aperture (43) in the upper body (42), i.e., the aperture located over the actuator button (39). These slots (50) are designed to accommodate the upper wing extensions (19A) of the wing extensions (19) from the sidewall of the central upright segment (20) of the spray channel (8). This interaction between the upper body (42) and spray channel (8) aids the good rotational alignment between the two.

Another feature that aids the good rotational alignment between the upper body (42) and spray channel (8) is a downward projecting peripheral wall (52) around the edge of the first aperture (43) in the upper body (42) and the fact that the actuator button (39) has the same shape as said first aperture (43).

The underside of upper body (42) also comprising three sets of two struts (53), some of which are illustrated in FIG. 8. These project inwards from the peripheral skirt (48) and are positioned to interact with the link walls (24) that form the radial edges of the peripheral projections (22A, 22B, and 22C) from the chassis (3) and thereby prevent rotation of the upper body (42) relative to the chassis 93).

Actuation of the sprayhead (1) and release of the contents of its associated aerosol can (2) is achieved by depression of the spray channel (8) by application of pressure on the associated actuator button (39). This can only be accomplished when the collar (3) is rotated such that the truncated wedge elements (33) protruding from the upper surface of the bridge (16) are not abutting the underside of the fore and aft projections (37 and 38, respectively) from the sidewall of the central upright segment (20) of the spray channel (8). In this position, the central upright segment (20) of the spray channel (8) is able to be pressed down through the central aperture (13) in the chassis (3) and through the annular ring (32) in the centre of the bridge (16) spanning the collar (4), to apply pressure on the valve stem of an associated aerosol can and thereby release the contents thereof through the spray channel (8).

Depression of the spray channel (8), when the collar is rotated as described in the paragraph immediately above, is limited by the bottoms of the fore and aft projections (37 and 38, respectively) and by the bottoms of the wing elements (19) all abutting the top surface of the annular ring (32) in the centre bridge (13) spanning the collar (4). This feature further protects the valve stem of the associated aerosol can. The fore and aft projections (37 and 38, respectively) and the wing elements (19) all extend to the same depth down the central upright segment (20) of the spray channel (8) to assist this.

When pressure is removed from the actuator button (39), a spring in the valve stem of the associated aerosol can forces the spray channel (8) to rise to its original position and the collar (3) may be rotated back to the position in which depression of the spray channel is prevented by the protrusions (33) from the upper surface of the bridge (16) abutting the underside of the fore and aft projections (37 and 38, respectively) from the central upright segment (20) of the spray channel (8).

The invention claimed is:

1. A sprayhead for use with a pressurized aerosol container, said sprayhead comprising:

a chassis capable of firm attachment to the pressurized aerosol container;

a rotatable circular collar located largely around and in close proximity to the chassis;

a spray channel and associated actuator button, said spray channel being designed to pass through a central aperture in the chassis; and an over-cap sitting over the chassis and the spray channel, the over-cap having an inner surface that includes a non-rotating feature wherein the rotatable circular collar is rotatable between a first position in which the sprayhead is inoperable and a second position in which the sprayhead is operable, and wherein in the first position, a first holding feature of the rotatable circular collar interacts with a first holding feature of the chassis providing rotational resistance to movement between the first position and the second position, and wherein a second holding feature of the rotatable circular collar interacts with a second holding feature on the chassis when the rotatable circular collar is in the second position; the rotatable circular collar further comprising a raised section sitting over the chassis, and a projection which interacts with the non-rotating feature of the over-cap to produce an audible signal when the rotatable circular collar is rotated to and from the first position and to and from the second position.

2. The sprayhead according to claim 1, wherein the first holding feature of the rotatable circular collar interacts with the first holding feature on the chassis when the rotatable circular collar is in the first position and the second holding feature of the rotatable circular collar interacts with the second holding feature on the chassis when the rotatable circular collar is in the second position.

3. The sprayhead according to claim 2, wherein the first holding feature of the rotatable circular collar is a first radial projection that extends radially inward from the rotatable circular collar and the second holding feature of the rotatable circular collar is a second radial projection that extends radially inward from the rotatable circular collar.

4. The sprayhead according to claim 3, wherein the first holding feature on the chassis and the second holding feature on the chassis are radial indents.

5. The sprayhead according to claim 1, wherein the projection from the rotatable circular collar which interacts with the non-rotatable feature of the over-cap to produce audible signals does so when the rotatable circular collar is rotated from the first position to an intermediate position, between the first position and the second position, and when the rotatable circular collar is rotated from said intermediate position to the second position.

6. The sprayhead according to claim 1, wherein the first holding feature of the rotatable circular collar and the second holding feature of the rotatable circular collar are part of the raised section sitting over the chassis.

7. A sprayhead according to claim 1, wherein the over-cap sits over the chassis, said over-cap defining an orifice suitable for a spray to be discharged therefrom.

8. The sprayhead according to claim 7, wherein the rotatable circular collar has one or more locking features that interact with one or more locking features on the spray channel to prevent depression of the actuator button and thereby operation of the sprayhead when the rotatable circular collar is in the first position.

9. The sprayhead according to claim 8, wherein the one or more locking features on the rotatable circular collar are upstanding from a bridge spanning a diameter of the rotatable circular collar and the one or more locking features on the spray channel protrude radially outward from an upright segment of the spray channel.

* * * * *